US005322970A

United States Patent [19]

Behe et al.

[11] Patent Number: 5,322,970

[45] Date of Patent: Jun. 21, 1994

[54] CERAMIC DONOR ROLL FOR SCAVENGELESS DEVELOPMENT IN A XEROGRAPHIC APPARATUS

[75] Inventors: Thomas J. Behe, Webster; Daniel R. Gilmore, III, Fairport, both of N.Y.

[73] Assignee: Xerox Corporation, Stamford, Conn.

[21] Appl. No.: 51,403

[22] Filed: Apr. 23, 1993

[51] Int. Cl.[5] ..... G03G 15/08

[52] U.S. Cl. ..... 118/651; 355/247; 355/259; 118/647

[58] Field of Search ..... 355/245, 259, 247-249; 118/653, 661, 654, 651, 647; 430/120

[56] References Cited

U.S. PATENT DOCUMENTS

| | | | |
|---|---|---|---|
| 3,950,089 | 4/1976 | Fraser et al. . | |
| 4,034,709 | 7/1977 | Fraser et al. | 118/658 |
| 4,544,828 | 10/1985 | Shigenobu et al. | 219/216 |
| 4,774,541 | 9/1988 | Martin et al. . | |
| 4,868,600 | 9/1989 | Hays et al. | 355/259 |
| 4,893,151 | 1/1990 | Yamazaki et al. | 355/245 |
| 4,984,019 | 1/1991 | Folkins | 355/215 |
| 5,010,367 | 4/1991 | Hays | 355/247 |
| 5,043,768 | 8/1991 | Baruch | 355/284 |
| 5,063,875 | 11/1991 | Folkins et al. | 355/247 |
| 5,128,723 | 7/1992 | Bolte et al. | 355/259 |

FOREIGN PATENT DOCUMENTS

| | | |
|---|---|---|
| 01-257881 | 10/1989 | Japan . |
| 03-20764 | 1/1991 | Japan . |

*Primary Examiner*—R. L. Moses
*Attorney, Agent, or Firm*—John S. Wagley

[57] ABSTRACT

A donor roll for the conveyance of toner in a development system for an electrophotographic printer includes an outer surface of ceramic. The ceramic has a suitable conductivity to facilitate a discharge time constant thereon of less than 600 microseconds. The donor roll is used in conjunction with an electrode structure as used in scavengeless development.

18 Claims, 3 Drawing Sheets

CERAMIC DONOR ROLL FOR SCAVENGELESS DEVELOPMENT IN A XEROGRAPHIC APPARATUS

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

In any type of scavengeless development apparatus, one of the most important elements is the donor roll which conveys toner particles to the wires forming the electrode structure in the nip between the donor roll and the photoreceptor. Broadly speaking, a donor roll can be defined as any roll having only toner particles adhering to the surface thereof. To function commercially in scavengeless development, a donor roll should meet certain requirements. In general, a donor roll should include a conductive core and define a partially conductive surface, so that the toner particles may adhere electrostatically to the surface in a reasonably controllable fashion. In hybrid scavengeless development, the donor roll provides an electrostatic "intermediate" between the photoreceptor and the transport roll. The provision of this intermediate and the scavengeless nip minimizes unwanted interactions between the development system and the photoreceptor, in particular with a pre-developed latent image already on the photoreceptor, before the latent image in question is developed. Minimized interactions make scavengeless development preferable when a single photoreceptor is developed several times in a single process, as in color or highlight color xerography.

The donor roll must further have desirable wear properties so the surface thereof will not be readily abraded by adjacent surfaces within the apparatus, such as the magnetic brush of a transport roll. Further, the surface of the donor roll should be without anomalies such as pin holes, which may be created in the course of the manufacturing process for the donor roll. The reason that such small surface imperfections must be avoided is that any such imperfections, whether pinholes created in the manufacturing process or abrasions made in the course of use, can result in electrostatic "hot spots" caused by arcing in the vicinity of such structural imperfections. Ultimately, the most important requirement of the donor roll can be summarized by the phrase "uniform conductivity;" the surface of the donor roll must be partially conductive relative to a more conductive core, and this partial conductivity on the surface should be uniform through the entire circumferential surface area. Other physical properties of the donor roll, such as the mechanical adhesion of toner particles, are also important, but are generally not as quantifiable in designing development apparatus. In addition, the range of conductivity for the service of a donor roll should be well chosen to maximize the efficiency of a donor roll in view of any number of designed parameters, such as energy consumption, mechanical control and the discharge time-constant of the surface.

The following disclosures may be relevant to various aspects of the present invention:

U.S. Pat. No. 4,868,600
Patentee: Hays et al
Issue Date: Sep. 19, 1989
U.S. Pat. No. 4,984,019
Patentee: Folkins
Issue Date: Jan. 8, 1991
U.S. Pat. No. 5,010,367
Patentee: Hays
Issue Date: Apr. 23, 1991
U.S. Pat. No. 5,063,875
Patentee: Folkins et al
Issue Date: Nov. 12, 1991
U.S. Pat. No. 3,950,089
Patentee: Fraser et al.
Issue Date: Apr. 13, 1976
U.S. Pat. No. 4,034,709
Patentee: Fraser et al.
Issue Date: Jul. 12, 1977
U.S. Pat. No. 4,774,541
Patentee: Martin et al.
Issue Date: Sep. 27, 1988
U.S. application Ser. No. 07/055,965
Patentee: Folkins et al.
Filing Date: Oct. 2, 1992
U.S. Pat. No. 4,544,828
Patentee: Shigenobu et al.
Issue Date: Oct. 1, 1985
U.S. Pat. No. 4,893,151
Patentee: Yamazaki et al.
Issue Date: Jan. 9, 1990
U.S Pat. No. 5,043,768
Patentee: Baruch
Issue Date: Aug. 27, 1991
U.S. Pat. No. 5,128,723
Bolte et al.
Issue Date: Jul. 7, 1992

The relevant portions of the foregoing disclosures may be briefly summarized as follows:

U.S. Pat. No. 3,950,089 discloses a development apparatus in which a surface for the direct conveyance of electrically-conductive toner comprises a dielectric sheath of a thickness of 1–25 mils, having a resistivity of $10^7$ to $10^9$ ohm-cm.

U.S. Pat. No. 4,034,709 discloses a development apparatus in which a surface for the direct conveyance of toner comprises styrene-butadiene, of a resistivity of $10^2$ to $10^6$ ohm-cm.

U.S. Pat. No. 4,774,541 discloses a development apparatus in which a surface for the direct conveyance of toner is doped with carbon black to a conductivity of $10^{-6}$ to $10^{-10}$ 1/ohm-cm.

Co-pending application Ser. No. 07/955,965, filed Oct. 2, 1992, discloses a phenolic resin coated on a donor roll. The use of phenolic resin coated donor rolls results in discharge time constants less than 300 microseconds.

In the prior art, there are a few instances in which the physical properties of ceramics are exploited for various purposes relating to development of electrostatic latent images.

U.S. Pat. No. 4,544,828 discloses a heating device utilizing ceramic particles as a heat source and adapted for use as a fixing apparatus.

U.S. Pat. No. 4,893,151 discloses a single component image developing apparatus including a developing roller coated with a Chemical Vapor Deposition ceramic and an elastic blade coated with a ceramic.

U.S. Pat. No. 5,043,768 discloses a rotating release liquid applying device for a fuser including an outer porous ceramic material.

According to the present invention, there is provided an apparatus for developing an electrostatic latent image. A housing defines a chamber for storing a supply of toner particles therein. A donor roll, with a ceramic outer surface, is mounted at least partially in the chamber of the housing to advance toner particles to the latent image. An electrode member is positioned in the space between the latent image and the donor roll, closely spaced from the ceramic surface of the donor roll and electrically biased to detach toner particles therefrom so as to form a toner powder cloud in the space between the electrode member and the latent image with detached toner particles from the toner cloud developing the latent image.

There is also provided an electrophotographic printing machine of the type having an electrostatic latent image recorded on a photoconductive member and a developer unit adapted to develop the latent image with developer material. The improved developer unit comprises a housing defining a chamber for storing a supply of developer material therein. The developer unit also comprises a donor roll, including a ceramic outer surface with a thickness ranging from about 0.17 to about 3.18 mm. The donor roll is mounted at least partially in the chamber of the housing and is adapted to advance developer material to the latent image. An electrode member is positioned in the space between the latent image and the ceramic outer surface of the donor roll. The electrode member is closely spaced from the donor roll and is electrically biased to detach developer material from the ceramic outer surface of the donor roll so as to form a powder cloud of developer material in the space between the electrode member and the latent image with detached developer material from the cloud of developer material developing the latent image.

There is further provided an electrophotographic printing machine of the type which has an electrostatic latent image recorded on a photoconductive member and a two component developer unit adapted to develop the latent image with developer material. The improved developer unit includes a housing which defines a chamber for storing a supply of carrier granules having toner particles adhering triboelectrically thereto. The improved developer unit also comprises a transport roll mounted in the chamber of the housing for advancing carrier granules and toner particles therefrom. The improved developer unit further comprises a donor roll which includes a ceramic outer surface. The donor roll is mounted at least partially in the chamber of the housing adjacent the transport roll to receive toner particles therefrom and is adapted to advance toner particles to the latent image. An electrode member is positioned in the space between the latent image and the ceramic outer surface of the donor roll. The electrode member is closely spaced from the ceramic outer surface of the donor roll and is electrically biased to detach toner particles from the donor roll so as to form a toner powder cloud in the space between the electrode member and the latent image with detached toner particles from the toner cloud developing the latent image.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
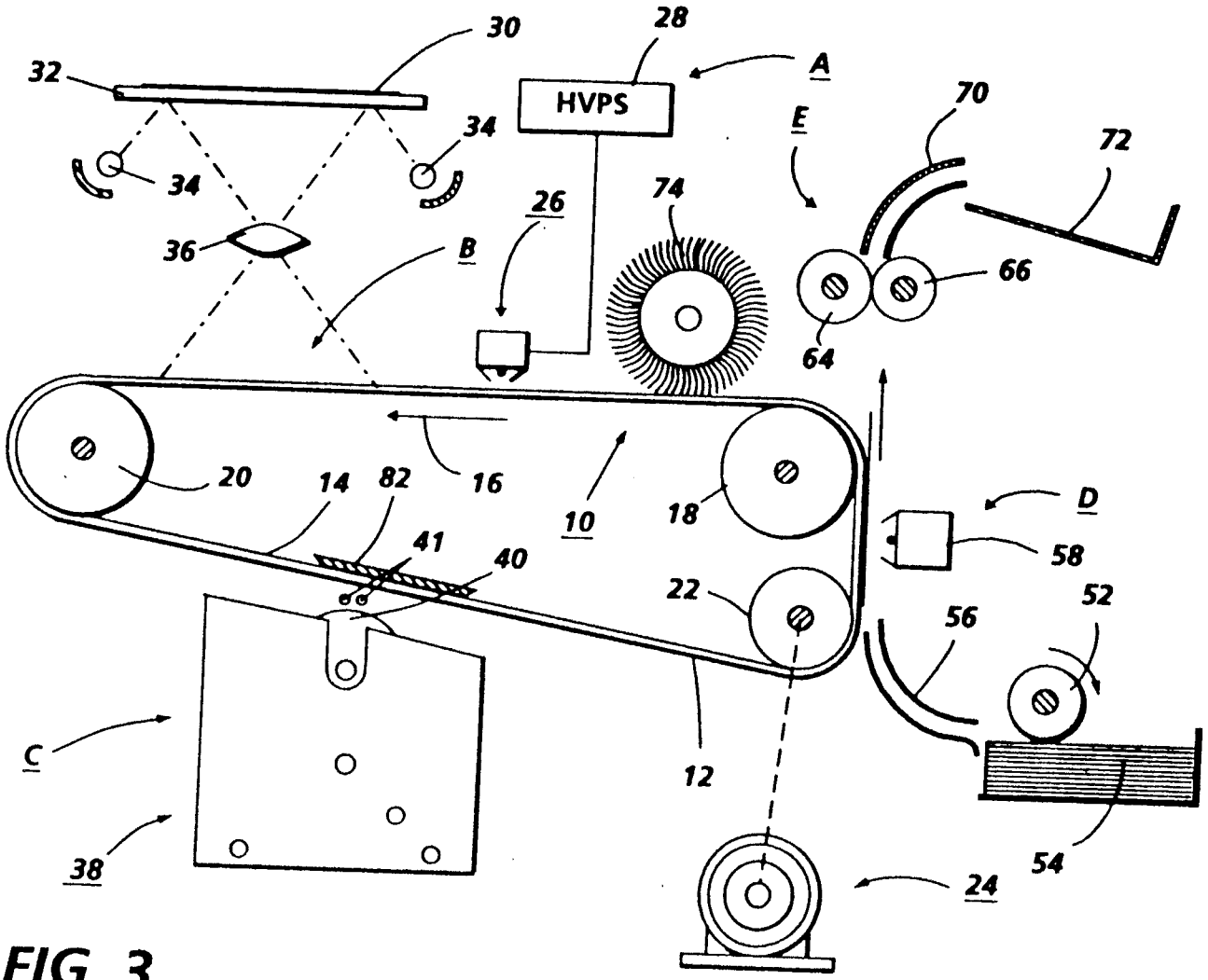
FIG. 3 is an elevational view of an illustrative printing machine in which the present invention may be used.

Referring initially to FIG. 3, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

Figure 1:
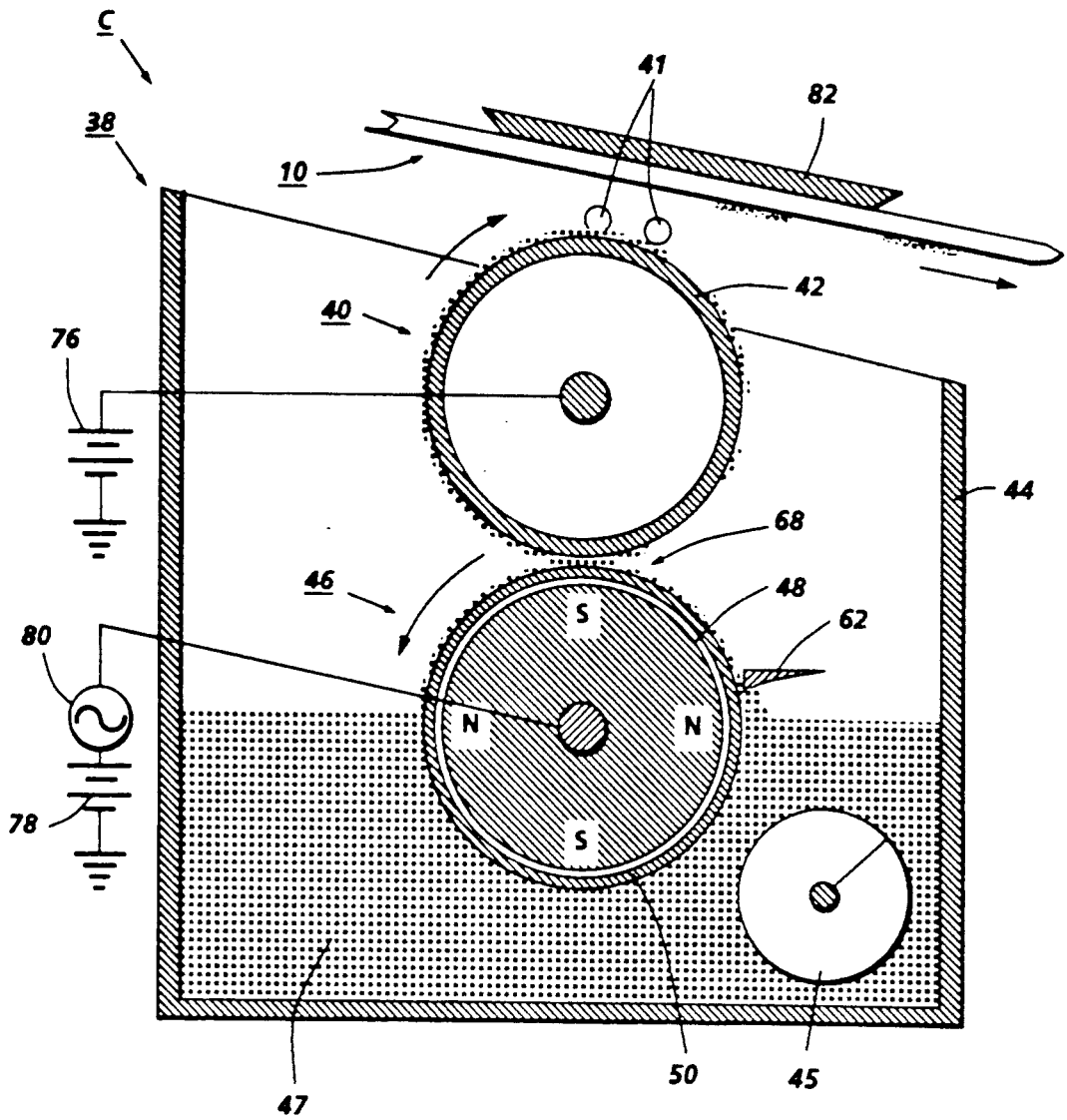
FIG. 1 is an elevational view of a developer unit using two component developer material incorporating the features of the donor roll of the present invention therein.
Figure 2:
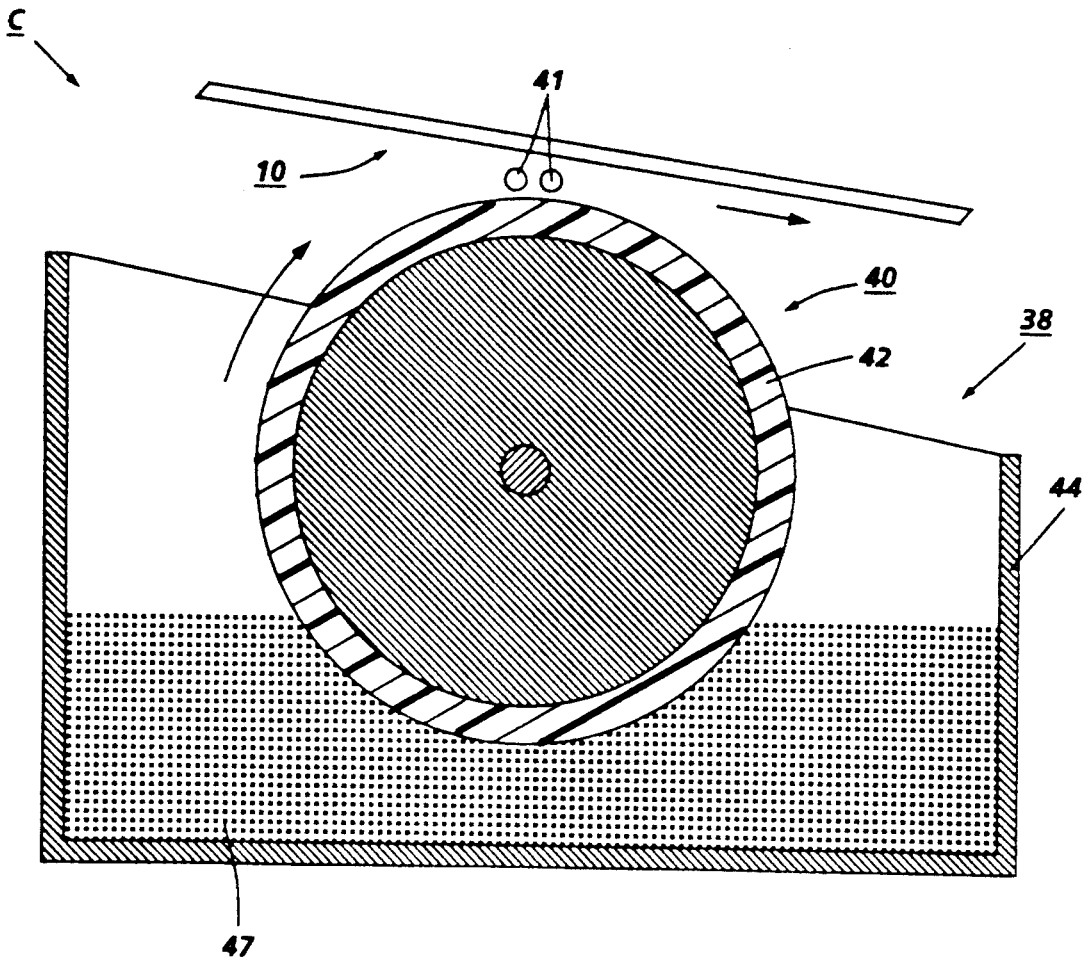
FIG. 2 is an elevational view of a developer unit using single component developer material incorporating the features of the donor roll of the present invention therein.

After the electrostatic latent image has been recorded on photoconductive surface 12, belt 10 advances the latent image to development station C as shown in FIG. 2. At development station C, a development system 38, develops the latent image recorded on the photoconductive surface. Preferably, development system 38 includes a donor roller 40 and electrode wires 41 positioned in the gap between the donor roll 40 and photoconductive belt 10. Electrode wires 41 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material 47. The developer material is a two component developer material of at least magnetic carrier granules having toner particles adhering triboelectrically thereto. A transport roller 46 disposed interiorly of the chamber of housing 44 conveys the developer material to the donor roller 40. The transport roller 46 is electrically biased relative to the donor roller so that the toner particles are attracted from the transport roller to the donor roller. Different embodiments of the development apparatus will be discussed hereinafter, in greater detail, with reference to FIGS. 1 and 2.

Again referring to FIG. 3, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Referring to FIG. 1, there is shown development system 38 in greater detail. Housing 44 defines a chamber for storing a supply of developer material 47 therein. The developer material includes carrier granules having toner particles adhering triboelectrically thereto. Positioned in the bottom of housing 44 is a horizontal auger 45 which distributes developer material uniformly along the length of transport roll 46 in the chamber of housing 44.

Transport roll 46 comprises a stationary multi-pole magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 meters the quantity of developer adhering to sleeve 50 as it rotates to the loading zone, the nip 68 between transport roll 46 and donor roll 40. The donor roll is kept at a specific voltage, by a DC power supply 76, to attract a layer of toner particles from transport roll 46 to donor roll 40 in the loading zone. Either the whole of the donor roll 40, or at least a peripheral layer thereof, is preferably of material which has low electrical conductivity, as will be explained in detail below. The material must be sufficiently conductive to prevent any build-up of electric charge with time, and yet its conductivity must be sufficiently low to form a blocking layer to prevent shorting or arcing of the magnetic brush to the donor roll.

Transport roll 46 is biased by both a DC voltage source 78 and an AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 1, or directly to the donor roll in series with supply 76.

It has been found that a value of up to 200 $V_{rms}$ is sufficient for the output of source 80 for the desired level of reload efficiency of toner particles to be achieved. The actual value can be adjusted empirically: in theory it could be any value up to a voltage of about 400 $V_{rms}$. The source should be at a frequency of about 2 kHz. If the frequency is too low, e.g. less than 200 Hz, banding will appear on the copies. If the frequency is too high, e.g. more than 15 kHz, the system would probably work but the electronics may become expensive because of capacitive loading losses.

Electrode wires 41 are disposed in the space between the belt 10 and donor roller 40. A pair of electrode wires are shown extending in a direction substantially parallel to the longitudinal axis of the donor roll 40. The electrode wires are made from one or more thin (i.e. 50 to 100 μm diameter) stainless steel wires which are closely spaced from donor roller 40. The distance between the wires and the donor roll 40 is approximately 25 μm or the thickness of the toner layer formed on the donor roll 40. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing. An alternating electrical bias is applied to the electrode wires by an AC voltage source (not shown). The applied AC establishes an alternating electrostatic field between the wires and the donor roller which is effective in detaching toner from the surface of the donor roller and forming a toner cloud about the wires, the height of the cloud being such as not to be substantially in contact with the belt 10.

At the development zone, i.e., the region where the photoconductive belt 10 passes closest to donor roll 40, a stationary shoe 82 bears on the inner surface of the belt. The position of the shoe relative to the donor roll establishes the spacing between the donor roll and the belt. The position of the shoe is adjustable and it is positioned so that the spacing between the donor roll and photoconductive belt is preferably about 0.4 mm.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport donor roll speed ratio of 3:1 has been found to be particularly advantageous, and even higher relative speeds might be used in some embodiments of the invention. In other embodiments the speed ratio may be as low as 2:1.

FIG. 2 is an elevational view of a single-component scavengeless development station. The specific design of the single-component station in FIG. 2 is generally disclosed in U.S. Pat. No. 5,128,723, assigned to the assignee of the present application. In FIG. 1 and 2, like reference numerals indicate like elements. As in the two component system of FIG. 1, the single-component system includes a donor roll 40 and electrode wires 41, but the donor roll 40 picks up toner to convey to the photoreceptor 10 directly from a supply of pure toner in the housing 44. In the single-component system of FIG. 2, there is no transport roll 46 and therefore no carrier beads are used in the developer. The specific design of the developer station in FIG. 2 may include special items useful in single-component developing, such as a charging rod (not shown) or electrically biased toner mover (not shown), the precise function of which is described in the above-referenced patent.

According to the present invention, and referring to either FIGS. 1 or 2, the outer surface 42 of donor roll 40 is a ceramic coating. A ceramic coating is a non-metallic, inorganic compound normally comprised of a blend pure oxide ceramics such as alumina, zirconia, thoria, beryllia, magnesia, spinel, silica, titania, and forsterite, which may be applied as a film to a metal substrate. Ceramics which include at least one of aluminum (Al), boron (B), carbon (C), germanium (Ge), silicon (Si), titanium (Ti), zirconium (Zr), magnesium (Mg), beryllium (Be) and tungsten (W) are particularly hard, highly abrasion resistive, have high resistivity, high dielectric strength, low dielectric loss, and a high dielectric constant and are, therefore, preferred for donor roll coating.

When this outer roll of ceramic is used, the core of donor roll 40 is intended to be of a conventional conductive material, such as aluminum. This ceramic coating is preferably plasma sprayed onto the core of the donor roll 40 with material properties and thicknesses chosen to obtain a preselected conductivity, and, if necessary, ground down through techniques well-known in the art to assume the desired precise dimensions for a particular development apparatus.

The wall thickness of the ceramic coating forming outer surface 42 is between 0.17 and 3.18 mm, on a donor roll 40 having a total outer diameter of approximately 25 mm; this thickness represents a compromise between concerns of ceramic material cost and grinding cost. It has been found that this ceramic coating is particularly suited for the design parameters of a donor roll in scavengeless development, either of the magnetic brush or single-component variety. Because the ceramic coating may be made with relatively thick walls, the thickness of the walls can be exploited to ensure that surface anomalies such as craters or pin holes are kept to a minimum. The use of a plasma spray method of applying the ceramic coating results in a much more uniform periphery geometry than that obtained from phenolic resin coating. Thus, grinding subsequent to plasma coating can often be eliminated. And, once again, because the ceramic coating is relatively easily worked, it is possible, if necessary, to grind down such a cylinder to a small extent to ensure precise dimensions.

The use of ceramic coated donor rolls results in discharge time constants roughly of from about 600 microseconds to slightly less than 60 microseconds. Discharge times as low as 60 microseconds greatly reduce discharge time and improve copying speed over similar systems with anodized aluminum donor rolls.

Ceramic coating has been shown to be a suitably hard substance which has presented no significant abrasion problems when placed within moving contact with a magnetic brush for an extended period. Many suitable compositions of ceramics have hardnesses in excess of Rockwell "C" 60 and are much harder than phenolic coatings. Thus, the use of harder ceramic materials results in fewer scratches and corresponding improvements in image copy quality.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. An electrophotographic printing machine of the type having an electrostatic latent image recorded on a photoconductive member and a developer unit adapted to develop the latent image with toner particles, wherein the improved developer unit comprises:

a housing defining a chamber for storing a supply of toner particles therein;

a donor roll including a ceramic outer surface, said donor roll being mounted at least partially in the chamber of said housing and being adapted to advance toner particles to the latent image; and an electrode member positioned in the space between the latent image and said ceramic outer surface of said donor roll, said electrode member being closely spaced from said ceramic outer surface of said donor roll and being electrically biased to detach toner particles from said ceramic outer surface of said donor roll so as to form a toner powder cloud in the space between said electrode member and the latent image with detached toner particles from the toner cloud developing the latent image, wherein said ceramic outer surface of said donor roll has a discharge time constant less than 600 microseconds.

2. An apparatus as in claim 1, wherein said ceramic outer surface of said donor roll has a conductivity greater than $10^{-8}$ (ohm-cm)$^{-1}$.

3. An apparatus as in claim 2, wherein said electrode member includes a plurality of wires spaced from one another.

4. An apparatus as in claim 3, further comprising a transport roll mounted in the chamber of said housing and being positioned adjacent said ceramic outer surface of said donor roll, said transport roll being adapted to advance toner particles to said ceramic outer surface of said donor roll.

5. An apparatus as in claim 4, further comprising means for applying an alternating electric field between said donor roll and said transport roll to assist in transferring at least a portion of the toner particles from said transport roll to said ceramic outer surface of said donor roll.

6. An apparatus as in claim 5, wherein said applying means applies an electrical field that alternates at a selected frequency ranging between about 200 Hz and about 20 kHz with a voltage less than 400 $V_{rms}$.

7. An electrophotographic printing machine of the type having an electrostatic latent image recorded on a photoconductive member and a developer unit adapted to develop the latent image with developer material, wherein the improved developer unit comprises:

a housing defining a chamber for storing a supply of developer material therein;

a donor roll, including a ceramic outer surface with a thickness ranging from about 0.17 to about 3.18 mm., said donor roll being mounted at least partially in the chamber of said housing and being adapted to advance developer material to the latent image; and an electrode member positioned in the space between the latent image and said ceramic outer surface of said donor roll, said electrode member being closely spaced from the donor roll and being electrically biased to detach developer material from said ceramic outer surface of said donor roll so as to form a powder cloud of developer material in the space between said electrode member and the latent image with detached developer material from the cloud of developer material developing the latent image.

8. A printing machine as in claim 7, wherein said ceramic outer surface of said donor roll has a discharge time constant less than 600 microseconds.

9. A printing machine as in claim 8, wherein said ceramic outer surface of said donor roll has a conductivity greater than $10^{-8}$ (ohm-cm)$^{-1}$.

10. A printing machine as in claim 9, wherein said electrode member includes a plurality of wires spaced from one another.

11. A printing machine as in claim 10, further comprising a transport roll mounted in the chamber of said housing and being positioned adjacent said ceramic outer surface of said donor roll, said transport roll being adapted to advance developer material to said ceramic outer surface of said donor roll.

12. A printing machine as in claim 11, further comprising means for applying an alternating electric field between said donor roll and said transport roll to assist in transferring at least a portion of the developer material from said transport roll to said ceramic outer surface of said donor roll.

13. A printing machine as in claim 12, wherein said applying means applies an electrical field that alternates at a selected frequency ranging between about 200 Hz and about 20 kHz with a voltage less than 400 $V_{rms}$.

14. An electrophotographic printing machine of the type having an electrostatic latent image recorded on a photoconductive member and a two component developer unit adapted to develop the latent image with developer material, wherein the improved developer unit comprises:

a housing defining a chamber for storing a supply of carrier granules having toner particles adhering triboelectrically thereto;

a transport roll, mounted in the chamber of said housing for advancing carrier granules and toner particles therefrom;

a donor roll including a ceramic outer surface, said donor roll being mounted at least partially in the chamber of said housing adjacent said transport roll to receive toner particles therefrom and being adapted to advance toner particles to the latent image; and an electrode member positioned in the space between the latent image and said ceramic outer surface of said donor roll, said electrode member being closely spaced from said ceramic outer surface of said donor roll and being electrically biased to detach toner particles from said donor roll as to form a toner powder cloud in the space between said electrode member and the latent image with detached toner particles from the toner cloud developing the latent image, wherein said ceramic outer surface of said donor roll has a discharge time constant less than 600 microseconds.

15. An apparatus as in claim 14, wherein said ceramic outer surface of said donor roll has a conductivity greater than $10^{-8}$ (ohm-cm)$^{-1}$.

16. An apparatus as in claim 15, wherein said electrode member includes a plurality of wires spaced from one another.

17. An apparatus as in claim 16, further comprising means for applying an alternating electric field between said donor roll and said transport roll to assist in transferring toner particles from said transport roll to said ceramic outer surface of said donor roll.

18. An apparatus as in claim 17, wherein said applying means applies an electrical field that alternates at a selected frequency ranging between about 200 Hz and about 20 kHz with a voltage less than 400 $V_{rms}$.

* * * * *